United States Patent [19]

Landau

[11] 4,358,222

[45] Nov. 9, 1982

[54] METHODS FOR FORMING SUPPORTED CAVITIES BY SURFACE COOLING

[76] Inventor: Richard E. Landau, Box 69, Malverne, N.Y. 11565

[21] Appl. No.: 215,145

[22] Filed: Dec. 10, 1980

Related U.S. Application Data

[63] Continuation-in-part of Ser. No. 3,808, Jan. 16, 1979, abandoned, Ser. No. 750,254, Dec. 13, 1976, abandoned, and Ser. No. 616,617, Sep. 25, 1975, abandoned.

[51] Int. Cl.[3] ..... E02D 19/14

[52] U.S. Cl. ..... 405/130; 405/248; 405/258

[58] Field of Search ..... 405/56, 130, 217, 238, 405/248; 165/45; 166/302; 175/17

[56] References Cited

U.S. PATENT DOCUMENTS

| | | | |
|---|---|---|---|
| 853,581 | 5/1907 | Fryer | 405/130 |
| 2,193,219 | 3/1940 | Bowie et al. | 405/130 X |
| 2,621,022 | 12/1925 | Bardill | 405/130 X |
| 3,183,675 | 5/1965 | Schroeder | 405/130 |
| 3,365,894 | 1/1968 | Murati | 405/130 |
| 3,434,294 | 3/1969 | Hall | 405/238 |
| 3,528,252 | 9/1970 | Gail | 405/130 |
| 3,608,317 | 9/1971 | Landau | 405/248 |
| 3,720,065 | 3/1973 | Sherard | 405/130 |

*Primary Examiner*—David H. Corbin

[57] ABSTRACT

This invention relates to the formation of cooled or frozen zones of soil or other granular material using low temperature fluids introduced to contact the material through a cavity forming tool which aids in cavity support until such time as the required cooling or freezing occurs. The coolant may be introduced into the cavity under pressure in a manner to provide intermediate cavity support during the tool withdrawal process, such pressure being retained in the formed cavity by virtue of the tool and material forming an effective seal to minimize inadvertent loss or venting of coolant to the atmosphere. As such, the cavities can be formed in any desired orientation, depending upon the direction of tool insertion. It is to be recognized that the introduction of coolant under pressure is not a requirement of the invention where the coolant has characteristics which will induce the necessary flow into the cavity.

The material in which the cavity is formed under the invention must contain a congelative fluid, which may exist prior to the insertion of the cavity forming tool or which may be introduced as part of the process of tool insertion and cavity formation. Therefor, the present invention permits application to soils and material which heretofore could not be rendered self-supporting by virtue of the lack of suitable congelative fluid in its granular materix. The invention is capable of being practiced to produce a cooled zone which increases in thicknesses with depth so as to develop the required strengths to resist the cavity destabilizing forces which normally increase with depth.

Such cavities formed as a result of practicing the invention may be utilized for the installation of support piling of all types, as the required support material can be introduced directly into the cavity by virtue of the cavity being rendered self-supporting to thereby remain open during the introduction of the selected support systems. Such cavities may be backfilled with materials and instrumentation of all types in a manner similar to placing support piling. Subsequent thawing of the congealed cavity periphery would permit the use of devices to either extract flowing fluid from the material, or the control of fluid levels in the material either by introducing or removal of desired fluid.

15 Claims, 4 Drawing Figures

METHODS FOR FORMING SUPPORTED CAVITIES BY SURFACE COOLING

This is a continuation-in-part of U.S. patent application Ser. No. 616,617 filed Sept. 25, 1975, titled "Methods for Forming Supported Cavities by Surface Cooling", also of U.S. patent application Ser. No. 750,254 filed Dec. 13, 1976 titled "Methods and Apparatus for Forming Supported Cavities by Surface Cooling", and of U.S. application Ser. No. 3,808 filed Jan. 16, 1979 titled "Methods for Forming Supported Cavities by Surface Cooling".

This invention relates to the formation of cavities in soil in a manner wherein at least a portion of the formed cavity is rendered self-supporting by congealing or freezing fluid contained within the soil matrix. More specifically, this invention involves the use of a cavity forming tool which provides substantially full support for at least a portion of the periphery defined by the tool for the full depth of penetration through the soil to be so treated by coolant, with such cavity support transferred from the tool to the congealed or frozen periphery, effected at least in part by virtue of the coolant introduced into the cavity formed as the tool is removed from the soil. The cavity support effected by the coolant may also initially relate in part to the pressure exerted by the coolant by virtue of its introduction below the lower end of the tool within the exposed cavity resulting from tool removal from the soil. The manner in which the tool contacts at least a portion of the periphery of the cavity during the process, results in the tool in conjunction with the soil forming an effective seal to impede the loss of coolant introduced into the cavity. While the description provided herein relates to cavities formed in soil, it is to be recognized that this invention can be practiced in connection with other types of granular materials containing fluids which can be congealed or frozen in a manner which results in strength improvement to effect a self-supporting characteristic. Where the soil or material to be rendered self-supporting does not initially contain fluid having the desired strength improvement characteristic, this invention provides for the initial adding of such fluid prior to the introduction of coolant as a separate step in the process.

Prior methods of soil treatment by use of low temperature fluid relate to freezing the soil below the natural water table, which in effect, results in the improvement in soil strength by forming ice in the soil matrix. Where brine is used as a coolant, the brine itself has been known to enter the soil matrix, and in some instances could retard the desired effect. Where liquified gas, such as Liquified Nitrogen is used, it is generally vented to the atmosphere when introduced directly to the cavity periphery. When the Liquified Nitrogen is controlled within a confined piping system to avoid excessive loss to the atmosphere in an uncontrolled manner, the cooling effect is normally accomplished by conduction through the piping, which is not as effective as direct contact of coolant with the soil.

To render a vertically oriented soil cavity self-supporting normally requires a greater strength improvement of the deeper soil as compared to the upper soil, as the lateral pressures causing cavity collapse generally increase in proportion to depth. Such pressure increase relates to the normal overburden soil loading, and below the water table added water pressures are involved. It is at once evident that a greater thickness of frozen zone is required as the depth of cavity increases. An efficient freezing process would therefore permit varying the thickness of the frozen or congealed zone with depth, in a substantially controllable manner.

The factors involved in soil strengthening by freezing include the heat transfer characteristics of the coolant as well as the material to be congealed or frozen, as well as the time of contact and the various temperatures involved. Where brine is involved, the specific heat values and the temperature difference that can be maintained below the desired final value for the cooled soil are important in determining the time to achieve the necessary cooling. Where liquified gas is involved, the latent heat of vaporization is normally the most important factor in rapid cooling of the material being treated. Although cooling through a closed piping system provides control of coolant, the most efficient cooling process normally involves the direct contact of coolant and the material treated.

The present invention pertains to a process utilizing liquified gas, such as Liquified Nitrogen, in a controlled manner to minimize loss to the atmosphere while controlling contact time with the material being cooled. The process involves introducing a cavity forming tool into the soil to initially define the periphery of the cavity, with the cavity formed by withdrawal of the tool, and exposing the periphery of the cavity to coolant introduced to the cavity at least during the tool withdrawal process. In this manner, the coolant is initially contained at the lowermost portion of the formed cavity, allowing a greater contact time as compared to the upper sections of the cavity, resulting in greater soil congealing and/or thicker segment of freezing in the lower areas as compared to the upper zones. Because the tool substantially fully contacts at least a portion of the periphery of the unexposed cavity during the withdrawal process, the gas formed by the vaporization process does not escape to the atmosphere and is maintained in contact with the exposed cavity periphery for the extent of time deemed necessary at any depth involved. As such, the rate of tool withdrawal can be controlled to maximize the temperature increase of the formed gas to more fully take advantage of temperature differences and heat transfer capacity between the coolant and the material treated. If desired, because of confinement of the coolant, any excess coolant can subsequently be salvaged by purging with a heavier gas or liquid, either to effect a cost saving if involved or to avoid pollution of the atmosphere in the instance where the coolant gas is considered dangerous.

The cavity may be formed in successive segments or in one full pass. The tool utilized in cavity formation maintains contact with the sidewalls of the defined cavity during the tool withdrawal process in the manner of a piston contacting the sidewalls of a cylinder. As the tool is withdrawn cavity support is relaxed in that the tool no longer provides support for the portion of the formed cavity which is exposed and no longer contacted by the tool. Were there no introduction of fluid into the cavity exposed, a vacuum would be induced which could effect collapse of the unsupported segment of the cavity exposed, even where lateral soil or material pressure as well as any existing exterior hydrostatic force may not exceed the intrinsic strength of the periphery of the exposed cavity. The introduction of fluid to the exposed cavity formed by tool withdrawal can be applied to minimize or totally avoid the occurrence of a vacuum, and such fluid may be applied under pressure to exert a positive force to provide support for the periphery of the cavity to prevent its collapse.

Liquified gas, such as Liquified Nitrogen, is often supplied in heavily insulated tanks with pressures of only a few atmospheres. When such liquids are introduced into a cavity its effectiveness as refrigerant is often related to taking on heat related to vaporization in returning to its gaseous state. This change in state can be aided by reducing its pressure, such as may be accomplished by exposing the liquid to atmosphere. In so doing, the cold gas is lost to the surrounding air and the efficient use of the material is limited or otherwise impaired. In the present invention, the tool functions as a piston during its withdrawal. The weight of coolant used can be minimized by allowing it to expand in the cavity as the tool is withdrawn. To maintain a positive pressure on the cavity periphery until the peripheral strength is increased by the effects of cooling, it is possible to introduce a second gas under pressure to provide the temporary cavity support. As the tool is withdrawn, the pressure of the second gas can be maintained at a level suitable for cavity support, while the coolant gas can change its state and pressure in accordance with the increasing volume of the exposed cavity. As such, without adding additional coolant, the increased cavity volume realized as the tool is withdrawn will translate as a reduction in coolant pressure aiding in its ability to change from liquified to gaseous state without loss of the capacity to maintain cavity support provided by the second gas, all in accordance with Boyle's Law of partial pressure and the relationships developed by John Dalton, as well as other applicable rules of Physics.

The implementation of the invention will be better understood by referring to the drawings, in which.

Figure 1:
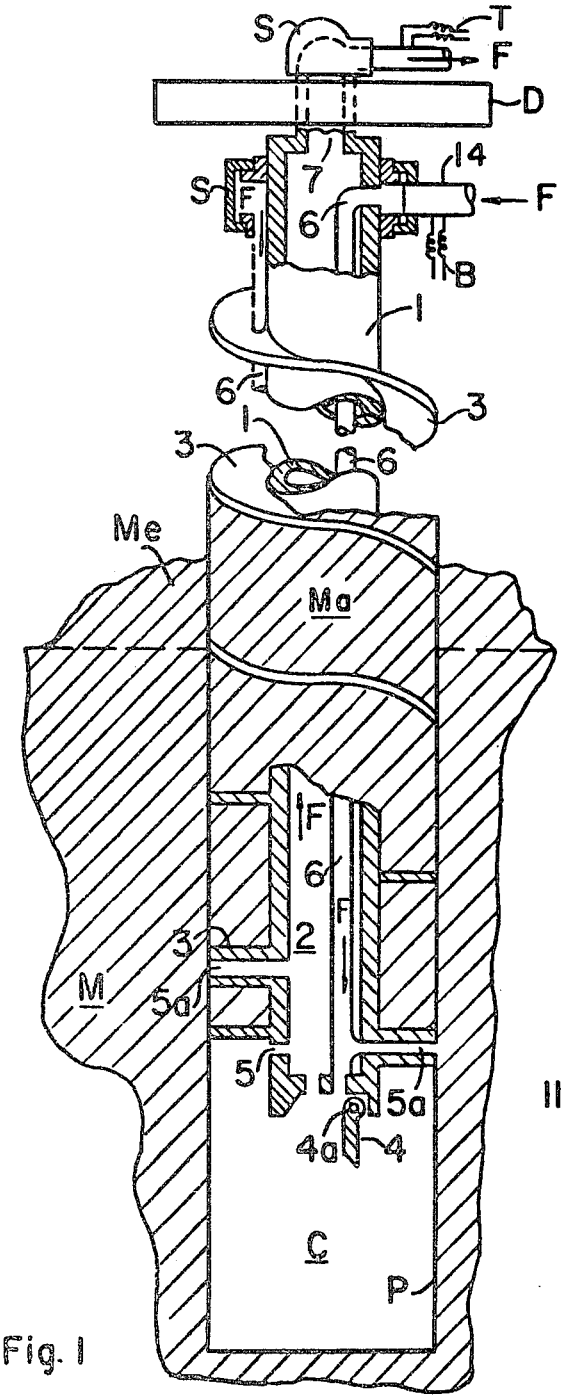
FIG. 1 shows a cross section of one form of cavity excavating tool, for practicing the invention; and involves the use of a flight auger having a hollow shaft and a retrievable cap.

The tool in FIG. 1 is introduced into the material by rotation, such as may be effected through drive, D, with the soil or material, Ma, conveyed to the surface along flights, 3, spiralling along the exterior of shaft, 1, to develop the cavity periphery, P, with least disturbance to the body of material, M. The tool consists of a center shaft, 1, which may be hollow, 2, to accommodate pipe, 6, to permit circulation of coolant, F, into and subsequently from formed cavity, C; e.g. via port 7. Ports, 5, and 5*a*, are arranged at the lower end of the tool for the introduction of coolant, F, at any time during the process. Cap, 4, which can be pivotable such as on pin, 4*a*, may be used to prevent intrusion of material into the hollow, 2, where applicable. A suitable disposable cap may be utilized (not shown). Where shaft, 1, is solid, pipe, 6, may be positioned externally to shaft, 1. Swivels, S, may be employed where permanent coolant connections are used.

Figure 2:
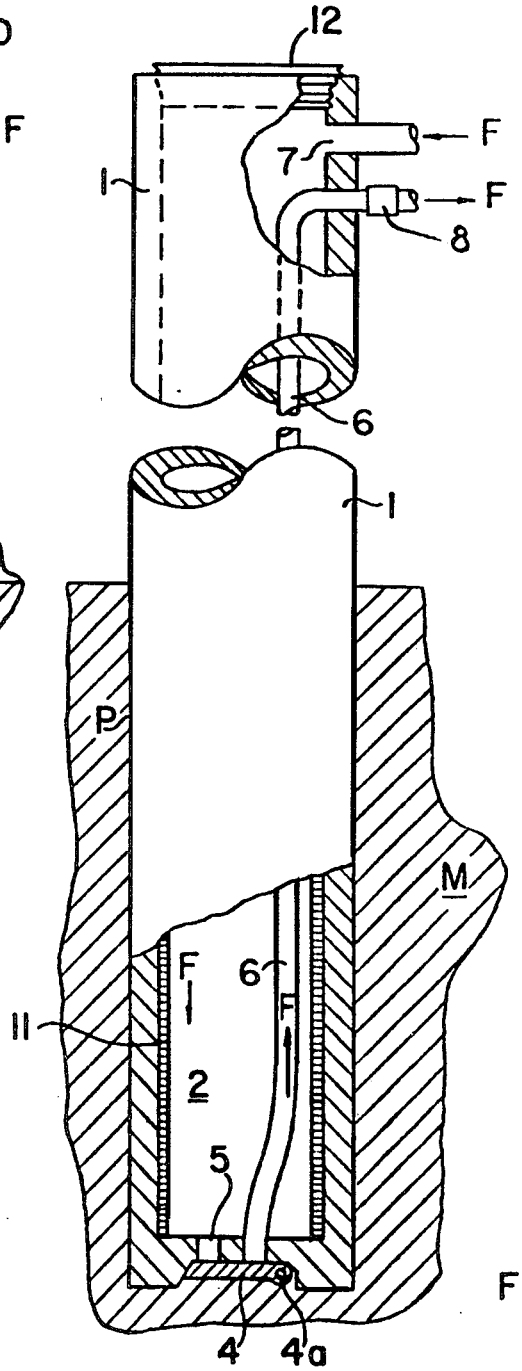
FIG. 2 shows a displacement type of tool applicable to cavity formation by expanding a hole laterally using a disposable cap.

The arrangement of the tool in FIG. 2 parallels FIG. 1 with the difference that the tool shaft, 1, is jetted, driven, or otherwise inserted into the material without rotation. As such, the flights, 3, the swivels, S, and the drive, D, are not applicable to this embodiment. Except for the process of tool insertion, the tools in FIG. 1 and FIG. 2 can be used to practice the invention in the following manner. The tool is inserted to the desired depth thereby defining periphery, P, which is supported by the tool and any material contained within the flights, 3, where used. As the tool is withdrawn, coolant, F, is introduced by natural flow or under pressure into the formed cavity, C. Where tool support has been removed, such support is effected by the coolant, F, which may be applied under pressure as needed. The coolant is introduced as needed as the tool is continued to be withdrawn, or the coolant is allowed to evaporate or otherwise expand within the cavity, C, to fill the increasing cavity volume as the tool is withdrawn. The control of the procedure may be effected through a system of temperature sensors, T, and other sensors, such as pressure sensors, B, at suitable points as will be evident to those familiar in the art. Based upon a knowledge of temperature and pressure characteristics, as well as contact time between the coolant and the material at various depths, the rate of tool withdrawal can be varied to insure the proper development of a suitably thick congealed or frozen zone of material. For tool insertion by jetting, congelative jetting fluid may be used where such needs to be added to the material.

In the embodiment shown in FIG. 1, the use of a flight auger permits avoiding lateral displacement of material in cavity formation such that successively placed cavities will not distort or cause the soil to move laterally to collapse previously formed adjacent cavities. The embodiments of FIG. 1 and FIG. 2 can be applied to forming the cavity in one full pass or in successive segmental passes. Shorter tool segments may be employed in forming segmental cavities, as are other tool types, such as are shown in FIG. 3 and FIG. 4.

Valve 8 in FIG. 2, may be sensor operated for use in flow control. In the alternate embodiment, FIG. 2, shaft, 1, may be suitably insulated, if necessary, to minimize the possibility of the shaft, 1, becoming frozen to the material, M. In both FIG. 1 and FIG. 2, the coolant, F, can be introduced to treat the material, M, through peripheral ports, 5*a* (not shown in FIG. 2), as the tool is inserted or withdrawn. The cavity can be exposed to coolant for as long a period of time as needed to develop the thicker zone of freezing as compared to the upper zones where lower stresses need to be resisted. Also, where dry material, M, is involved, the matrix of the material, M, can be wetted as needed to insure that subsequent congealing or freezing is performed in a manner to strengthen the material, M, at the cavity periphery, P. Such wetting can be effected through the various available ports, such as 5*a* and also 5 if necessary, prior to the introduction of coolant, F, during the time of tool extraction. Thus, the wetting can be done while the tool is being inserted, and the cooling can be performed while the tool is being taken out of the material, M.

The piping system connections, or the venting system, may be utilized as a means for introducing a second gas separate from the coolant fluid. The valve, 8, may be utilized in the form of a pressure sensitive or vacuum sensitive valve to control the inflow of fluid into the cavity.

Figure 3:
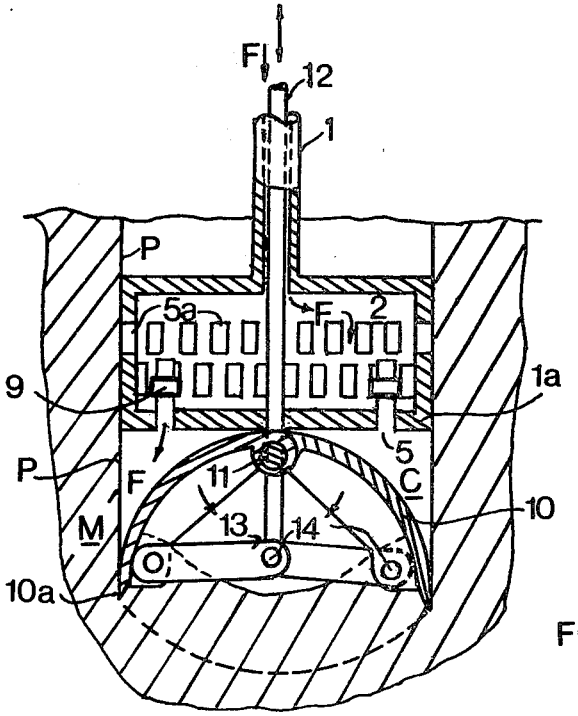
FIG. 3 shows a clamshell type of excavating tool.
Figure 4:
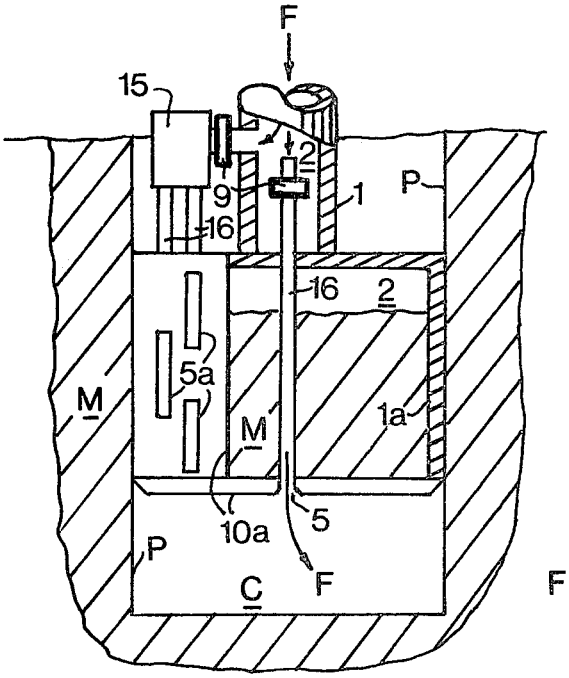
FIG. 4 shows a bucket type auger excavating tool.

The tool of FIG. 3 is a form to permit segmental cavity formation by utilizing clamshell type bucket segments, 10, pivoted at 11, and controlled the rough a remotely operated rod, 12, and linkage, 13, connected to the elements at pinned ends, 14, to control the segments, 10. The shaft, 1, through which rod, 12, passes is hollow and expands to the cavity periphery, P, by its full size, 1*a,* which contains its hollow, 2, connecting to that of hollow shaft, 1. When the clamshell segments, 10, are moved together (see arrows), its cutting edges, 10*a,* gather material, M, and extend the cavity, C, thereby. Coolant, F, passing through the hollow, 2, and then through control type valves, 9, congeals the material, M, at the periphery, P, as desired. Other points of coolant entry, 5*a,* function in a manner similar to that for FIG. 1.

The tool of FIG. 4 is similar to that of FIG. 3, except that its cutters, 10*a,* are fixed along the expanded shaft, 1*a,* in the form of a bucket type auger at the side and bottom of the expanded shaft. 1*a.* The coolant, F, may additionally be controlled through a plenum, 15. Coolant can feed through conduits, 16, to introduce coolant to the periphery, P, and to the cavity through ports 5, and 5*a.* Material, M, is gathered in the hollow, 2, for extraction to the surface.

The descriptions presented herein are not to be construed as limiting the invention, but rather to suggest that more than one variation exists in the practice of the invention. Whereas this invention is most appropriately used involving liquified gas, other expandable fluids as well as liquids may be used as coolants as well. The means of tool withdrawal can be by (a) pulling the tool (b) the upward force of coolant pressure, (c) the push effected by the expansion of the coolant under pressure in the confined limits of the cavity, such pressure being augmented by warming, and (e) a combination of these or other means as may be evident to those familiar in the art.

The foregoing description of the forms of the invention can be implemented in many variations by those familiar in the art, while retaining the essence of the invention. Although the drawings do not indicate in detail the various configurations of equipment possible, nor the details of use of sensors to control coolant flow, special valving, and other aspects that may be useful to implement the invention, the descriptions presented will permit those knowledgeable in the art to practice the invention in its various applicable forms. Those familiar in the art will be able to utilize the invention to formulate equipment able to produce specific as well as variable cavity shapes; and by successive abutting installations form other or extended shapes, as may be applied to the formation of walls of all types and supports.

I claim:

1. A method of forming supported cavities in material containing congelative fluid, comprising;

(a) advancing a cavity forming tool into said material to define the periphery of said cavity, said tool initially providing peripheral support as necessary by direct contact of said tool with said periphery, (b) extracting said tool subsequently from said material to form said cavity incrementally as defined by the segment of periphery exposed as the tool is withdrawn, (c) introducing coolant into said cavity increment requiring periphery support substantially simultaneously with cavity exposure in a manner to permit the coolant to coact with said periphery and provide intermediate support as needed, and (d) maintaining the coolant within the defined cavity segment until the congelative fluid in the material at the cavity periphery is suitably congealed and the material strengthened thereby to render the periphery of said cavity at least temporarily self-supporting.

2. The method of claim 1 wherein the congelative fluid in the material is introduced at least in part during tool advance into the material.

3. The method of claim 1 wherein the coolant is initially introduced to a limited portion of the defined periphery through at least one port fixed along the perimeter of said tool in a manner to limit the portion of the defined periphery exposed to coolant to the area substantially traversed by said port as the tool is advanced into said material.

4. The method of claim 1 wherein the coolant is a fluid.

5. The method of claim 1 wherein the coolant is liquified gas.

6. The method of claim 1 wherein the coolant is maintained in the cavity segment confined by the tool in contact with the unexposed portion of the defined periphery, and the coolant is subsequently scavanged at least in part prior to full withdrawal of the tool from the material by introducing a displacing medium to replace said coolant.

7. The method of claim 1 wherein said incrementally formed cavity is confined at least in part by the tool in contact with said defined periphery, which substantially forms a seal which follows with the tool as it is withdrawn and thereby permitting the coolant to be introduced into said cavity segment under pressure.

8. The method of claim 1 where the tool is inserted by rotation.

9. The method of claim 1 wherein the tool is introduced into said material by driving.

10. The method of claim 1 wherein said tool is utilized as a means for adding congelative fluid to said material to render said material more suitable to coacting with said coolant for the purpose of effecting cavity support.

11. The method of claim 1 wherein said congelative fluid is introduced under pressure in a manner which lowers the resistance of said material in the movement of said tool through said material.

12. The method of claim 5 wherein said liquified gas coolant reverts to its gaseous state during cooling, and a second gas is introduced into the formed cavity to develop at least partial support of the formed cavity.

13. The method of claim 12 wherein a second gas is introduced under pressure to said cavity to coact with said liquified gas to provide at least partial cavity support during the withdrawal of the cavity forming tool.

14. The method of claim 1 wherein the coolant supply to congeal the material is controlled in a manner that varies the congealed thickness with depth.

15. The method of claim 7 wherein the coolant under pressure within said cavity segment assists in the extraction of said tool from said material.

* * * * *